United States Patent [19]

Kupcikevicius

[11] Patent Number: 5,062,252

[45] Date of Patent: Nov. 5, 1991

[54] VACUUM PACKAGING METHOD AND APPARATUS

[75] Inventor: Vytautas Kupcikevicius, Oaklawn, Ill.

[73] Assignee: Viskase Corporation, Chicago, Ill.

[21] Appl. No.: 564,231

[22] Filed: Aug. 8, 1990

[51] Int. Cl.[5] ..... B65B 31/02

[52] U.S. Cl. ..... 53/434; 53/479; 53/512; 53/374.8

[58] Field of Search ..... 53/95, 249, 91, 373, 53/405, 433, 434, 479, 481, 511, 512, 408, 86; 198/377, 378

[56] References Cited

U.S. PATENT DOCUMENTS

| | | | |
|---|---|---|---|
| 3,486,295 | 2/1967 | Rausing et al. . | |
| 3,511,021 | 3/1968 | Lyon et al. | 53/512 |
| 3,699,742 | 10/1972 | Giraudi | 53/512 X |
| 3,832,824 | 9/1974 | Burrell . | |
| 3,851,437 | 12/1974 | Waldrop et al. | 53/512 |
| 3,958,391 | 5/1976 | Kujubu | 53/512 |
| 4,471,599 | 9/1984 | Mugnai | 53/512 X |
| 4,478,025 | 10/1984 | Scanlan | 53/434 |
| 4,578,928 | 4/1986 | Andre et al. | 53/512 |
| 4,583,347 | 4/1986 | Nielsen | 53/434 |
| 4,586,320 | 5/1986 | Takai et al. | 53/512 |
| 4,640,081 | 2/1987 | Kawaguchi et al. | 53/512 X |
| 4,754,596 | 7/1988 | Yasumune et al. | 53/512 X |
| 4,779,398 | 10/1988 | Glandon et al. | 53/512 X |

*Primary Examiner*—John Sipos

*Attorney, Agent, or Firm*—Roger Aceto

[57] ABSTRACT

Vacuum packaging method and apparatus for heat sealable bags in which a clamp is used to effect a temporary air-tight seal of an evacuated bag while the bag is transported through a region of atmospheric pressure to a heat sealer. After heat sealing to effect a permanent air-tight closure, the clamp is open and the bag removed.

31 Claims, 7 Drawing Sheets

VACUUM PACKAGING METHOD AND APPARATUS

TECHNICAL FIELD

The present invention relates generally to a method and an apparatus for vacuum packaging food items in heat sealable plastic bags.

BACKGROUND OF THE INVENTION

Vacuum packaging in heat sealable plastic bags is a conventional way of packaging food items such as whole fowl, cuts of meat, cheese bricks and the like for sale at retail. Vacuum packaging involves placing the food item in a heat sealable plastic bag and then communicating the bag to a partial vacuum to evacuate air from the bag and collapse it about the food item. The bag is heat sealed in its evacuated condition so the food item becomes encased in a generally air-free environment.

It also is customary to fabricate the bag from a heat shrinkable plastic film. After sealing, the bagged food item is immersed in hot water or otherwise exposed to heat to shrink the bag so it is tight about the food item. This makes the bag substantially wrinkle-free and enhances the appearance of the bagged article for retail sale.

Apparatus, as disclosed for example in U.S. Pat. No. 3,958,391, has been developed to automate the vacuum packaging operation. The apparatus as disclosed in this patent has a plurality of platens arranged for movement along a closed path of travel. Each platen includes a heat sealer and is adapted to receive a bagged article wherein the open mouth of the bag is draped across the heat sealer.

During the course of moving through its closed path of travel, each platen merges with a vacuum chamber. The chamber presses against the platen and, for a portion of the path, it moves along with the platen. During this time the chambers are evacuated to remove air from the bags and the heat sealers are operated to close the bags. Each vacuum chamber then vents to atmosphere and thereafter separates from the platen so the bagged article can be removed.

Since each platen has its own heat sealer, provision must be made for supplying electrical power to each platen moving along the path of travel. It also is customary to supply each platen with other utilities. For example, water is supplied for cooling the heat sealer and pressurized air is supplied for closing the heat sealer. The need for multiple heat sealers and for supplying several utilities to each platen compounds maintenance problems and the systems required to supply multiple utilities to each moving platen adds to the complexity of the system.

The present invention eliminates the need for multiple heat sealers and for the delivery of electrical power, cooling water and other utilities to each platen moving through a closed path of travel. Instead, each platen in the present invention is provided with a mechanically operated clamp. The clamp closes about the bag after evacuation and maintains the bag in an evacuated state even after the vacuum chamber separates from the platen. The path of travel followed by each platen carries it to a heat sealing zone containing at least one operable heat sealer which operates to heat seal each bag carried by a platen through the heat sealing zone.

SUMMARY OF THE INVENTION

A vacuum packaging method of the present invention can be characterized by the steps of:

a) placing an open article-containing sealable bag at a loading zone and drawing the open neck of the bag to a flat width over a first clamp surface;

b) moving the article-containing bag and first clamp surface in to an evacuation zone and at least partly evacuating air from the bag through the open neck while holding the neck at substantially its flat width over the first clamp surface;

c) moving a second clamp surface against the first clamp surface in the evacuating zone and clamping the bag neck therebetween for effecting a temporary gas-tight seal of the evacuated, article-containing bag;

d) moving the evacuated, article-containing bag from the evacuation zone through a region of atmospheric pressure to a sealing zone and maintaining said temporary gas-tight seal during said movement through the atmospheric pressure region;

e) sealing the clamped bag neck across its flat width in the sealing zone thereby effecting a permanent gas-tight seal closure of the bag neck; and f) moving the permanently sealed, evacuated, article-containing bag from the sealing zone to an unloading zone, unclamping the bag neck and removing the permanently sealed article-containing bag from between the said clamping surfaces.

A vacuum packaging apparatus of the present invention can be characterized by:

a) a carrier adapted to receive an open-necked bag containing an article to be packaged, said carrier being transportable through successive loading, evacuating, sealing and unloading zones;

b) said apparatus having a region of atmospheric pressure between said evacuating and sealing zones;

c) clamp means on said carrier movable between an open position and a closed position and being constructed and arranged to clamp said open bag neck to substantially its flat width;

d) drive means on said carrier for moving said clamp means between said open and closed positions;

e) first activating means in said evacuating zone for activating said drive means to move said clamp means to said closed position after at least partial evacuation of said article-containing bag to effect a temporary air-tight seal of said article containing bag and thereafter maintaining said clamp means in said closed position during movement of said carrier through said region of atmospheric pressure;

f) sealing means in said sealing zone for effecting a permanent air-tight seal closure of said clamped bag neck across its flat width; and g) second activating means after said sealing zone for activating said drive means to move said clamp means to said open position thereby releasing said bag neck and allowing the removal of said permanently sealed article-containing bag from said carrier in said unloading zone.

Figure 2:
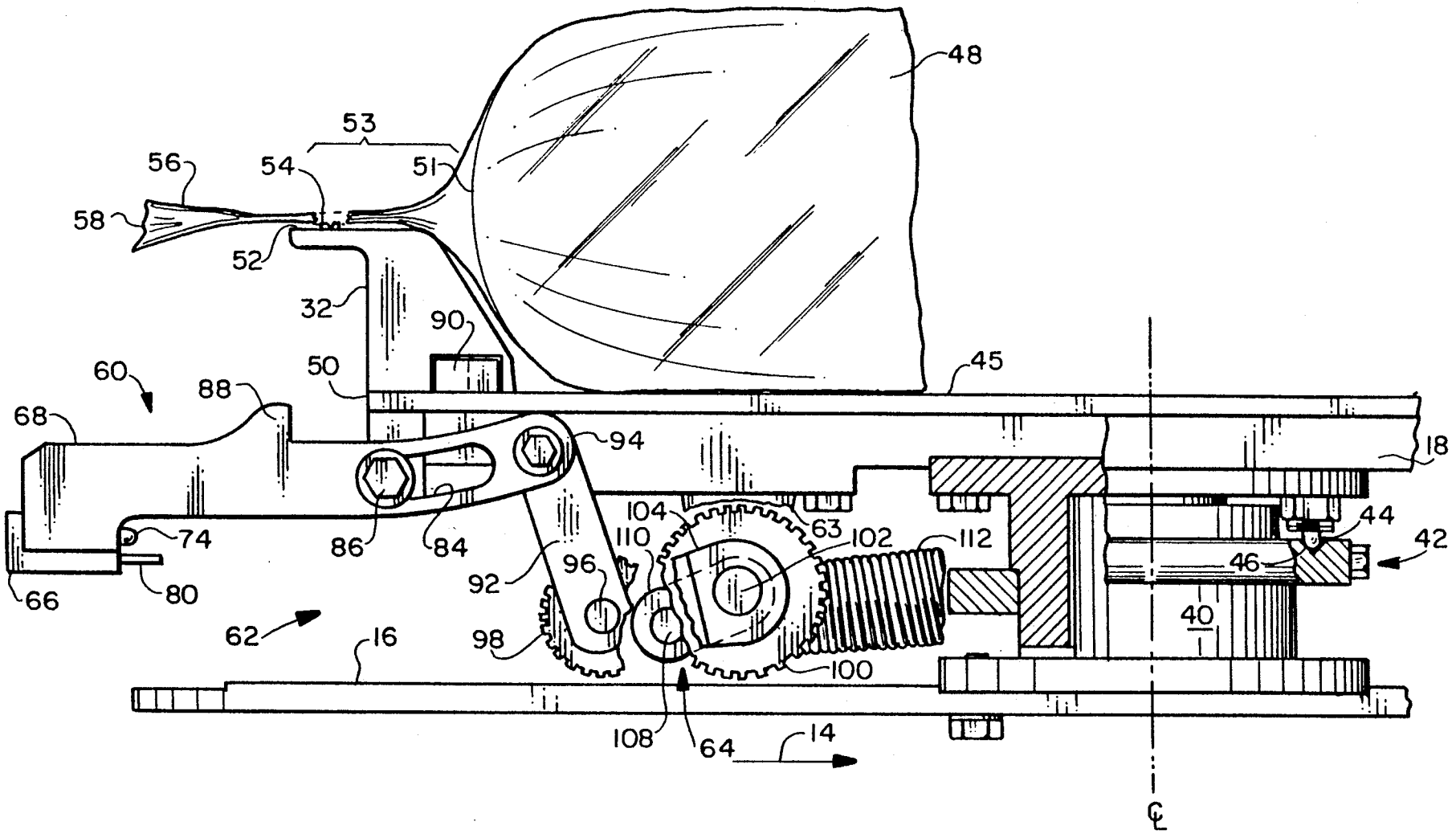
FIG. 2 is a side elevation view partly broken away and in section taken generally along lines 2—2 of FIG.
Figure 3:
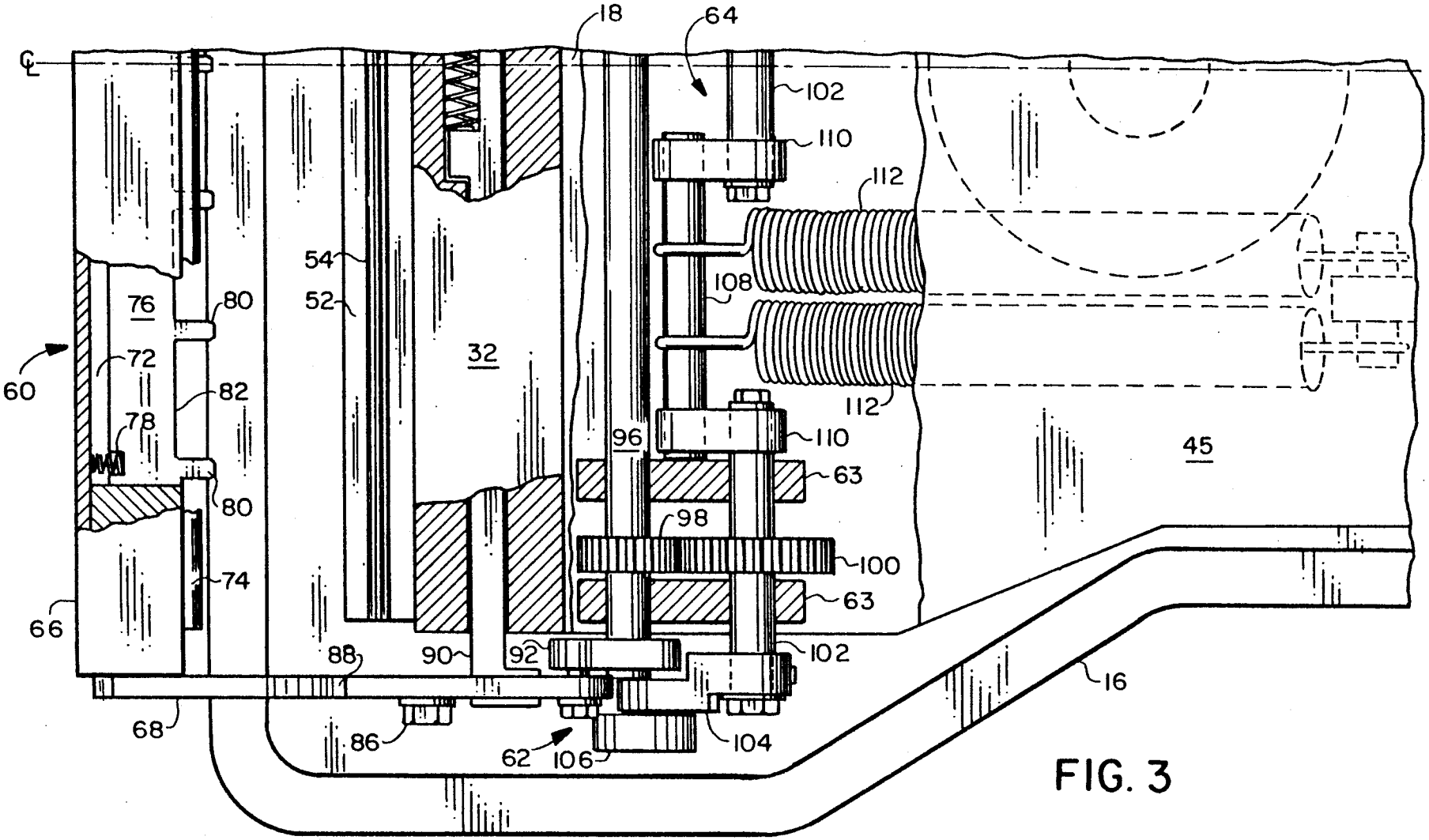
Figure 4:
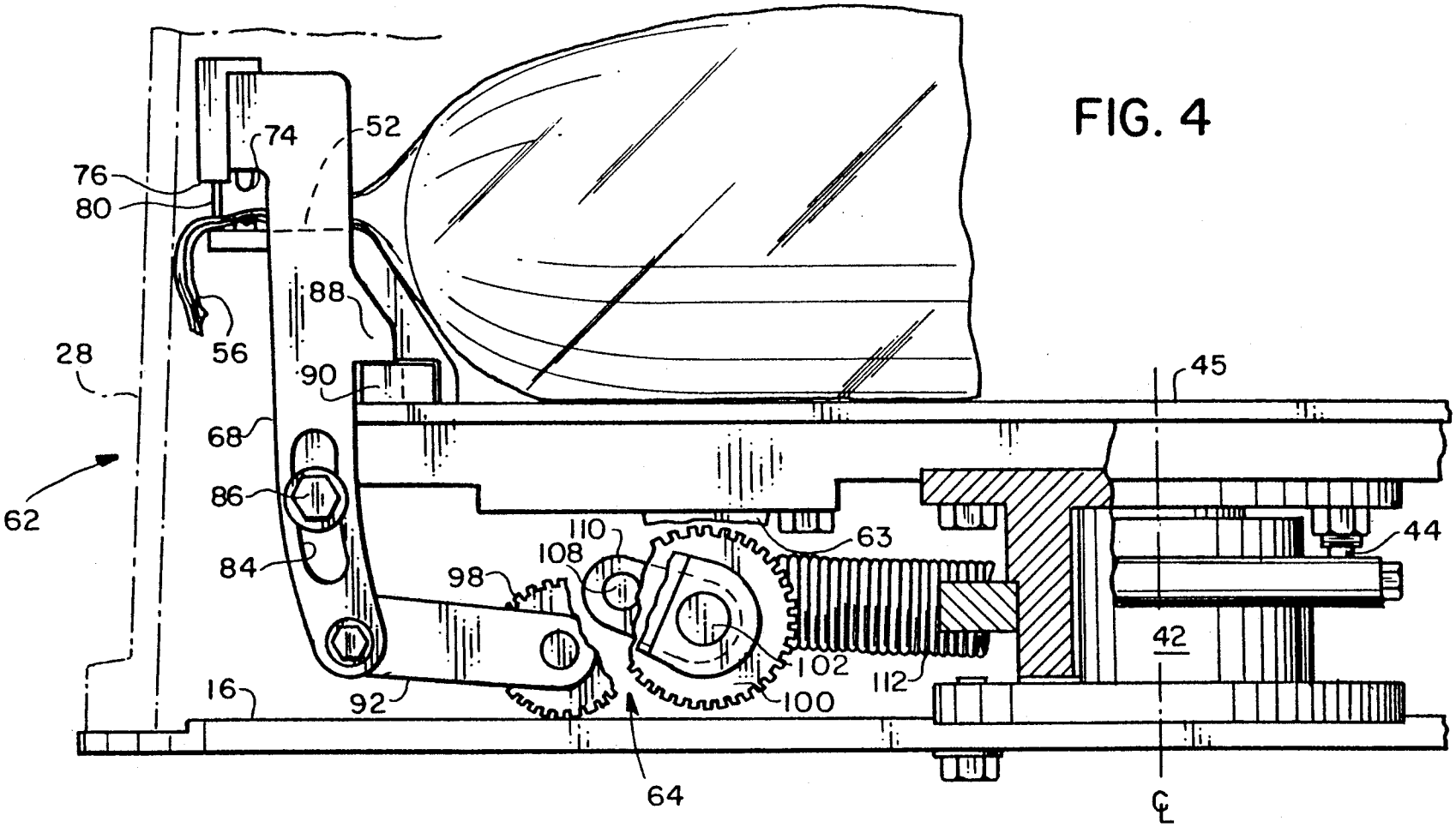
Figure 5:
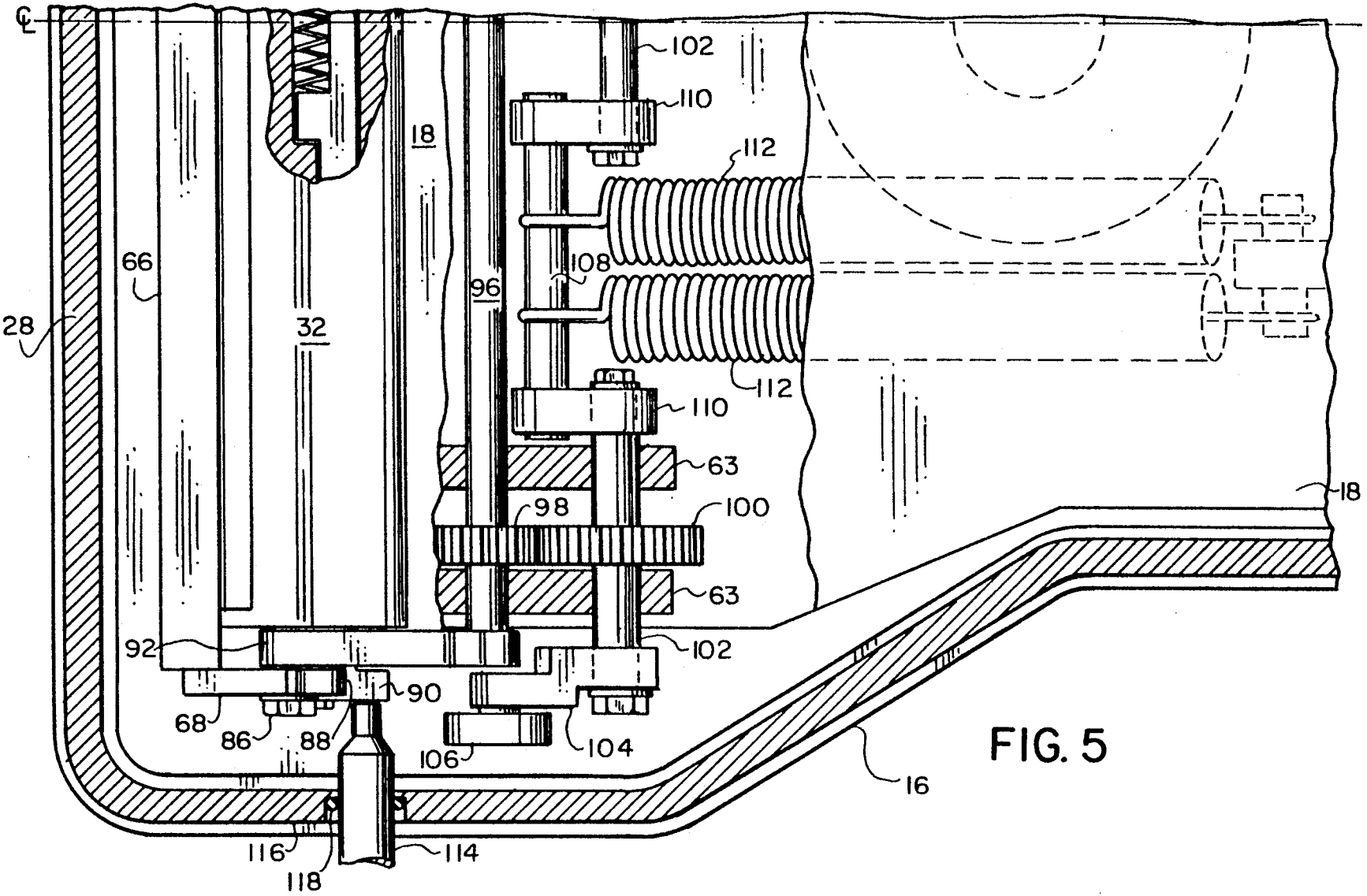
Figure 6:
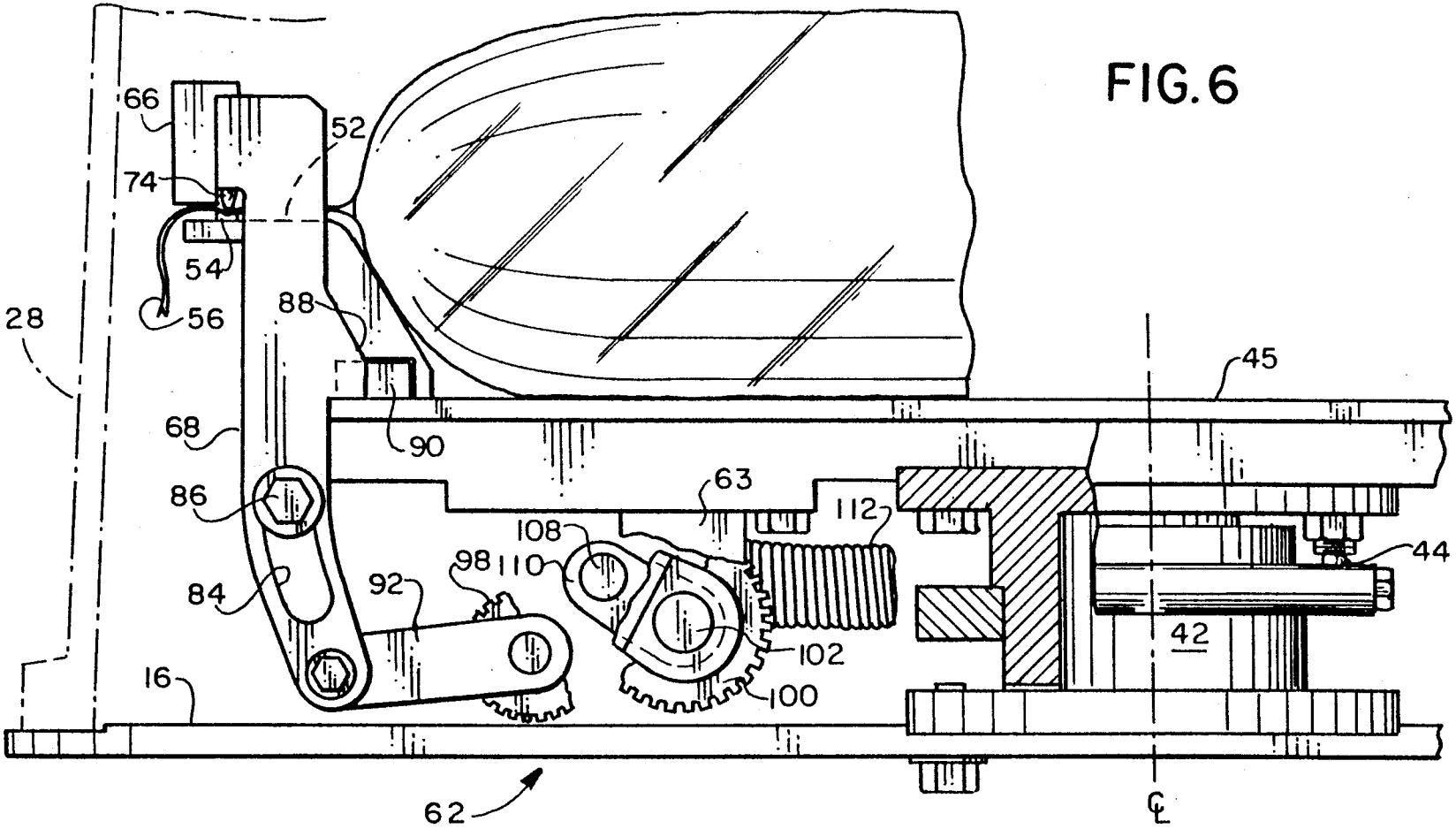
Figure 7:
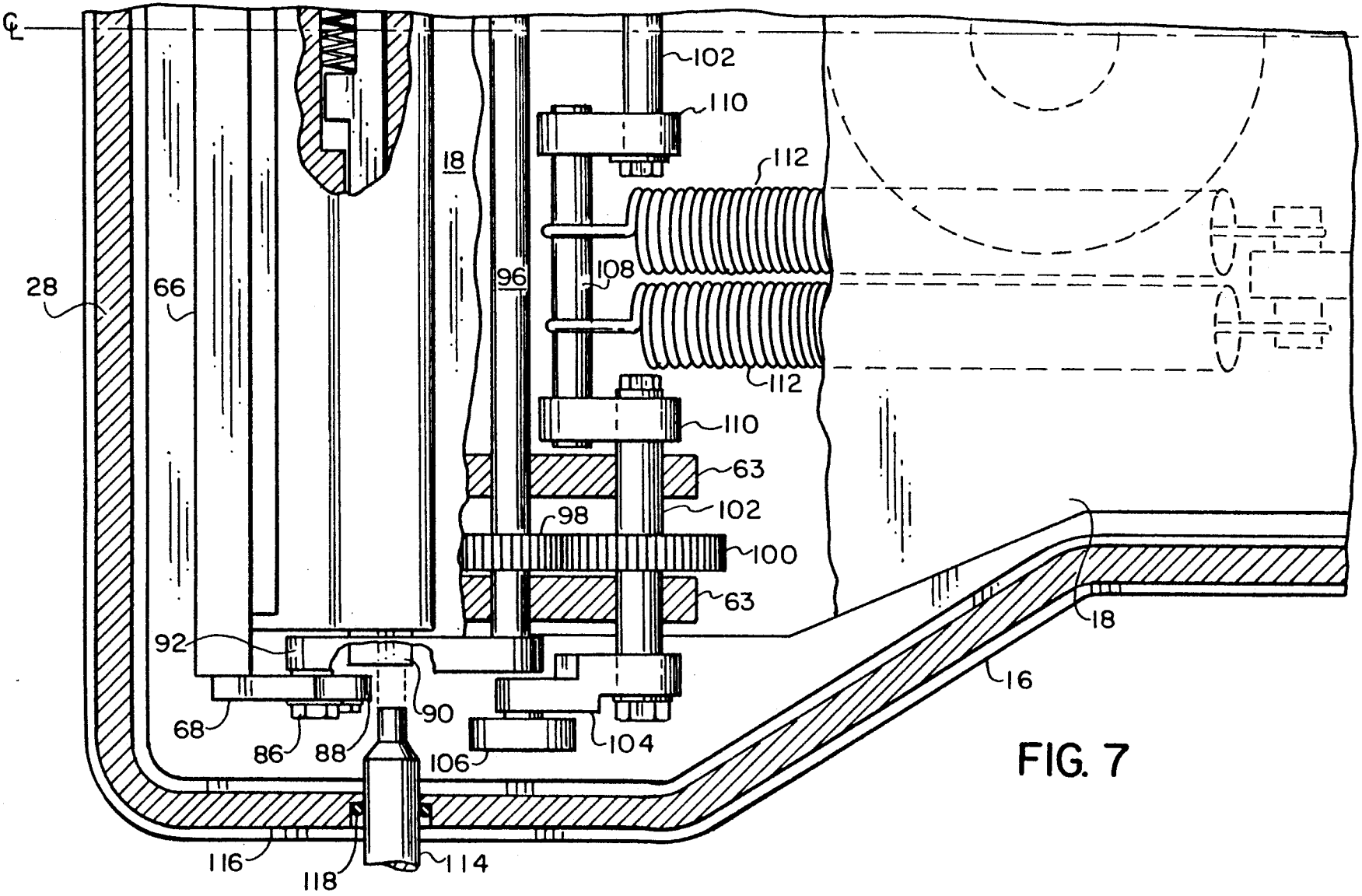

1 showing selected components of the apparatus of the present invention in a bag receiving position;

FIG. 3 is a plan view of FIG. 2 with portions broken away and in sections to show selected components of the present invention;

FIGS. 4 and 5 are views similar to FIGS. 2 and 3 only showing selected components in a bag evacuating position; and FIGS. 6 and 7 are views similar to FIGS. 2 and 3 only showing selected components in a bag clamping position.

DESCRIPTIONS OF THE PREFERRED EMBODIMENTS

Figure 1:
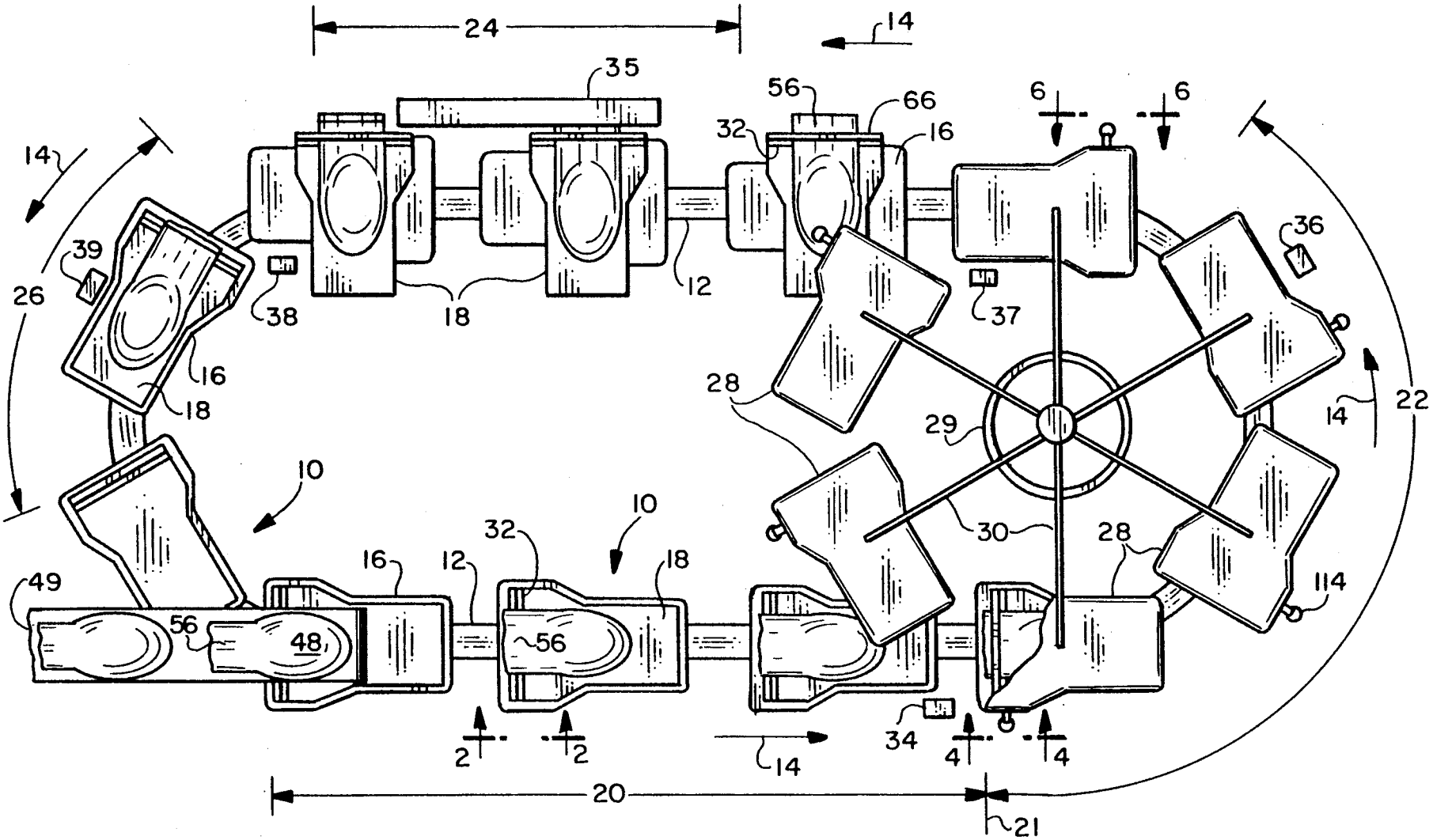
FIG. 1 is a schematic plan view of a vacuum packaging apparatus in accordance with an embodiment of the present invention.

Referring to the drawings, FIG. 1 shows the apparatus of the present invention to comprise a plurality of bag receiving units each generally indicated at 10. The units are spaced along a conveying means 12 for movement through a closed path of travel in the direction as indicated by arrows 14. The conveying means preferably is an endless chain or conveyor belt.

Each bag receiving unit 10 has an elongated or generally rectangular configuration and includes a carriage 16 fixed to the conveying means 12. The carriage is arranged such that its longer dimension is oriented parallel to the path of travel. Each bag receiving unit 10 also includes a platen 18 supported by the carriage. The platen is a carrier for the bag to be evacuated and heat sealed and it has a configuration similar to, but slightly smaller than, its associated carriage 16.

Each platen is journaled to its supporting carriage so that it can be rotated to a position transverse the carriage path of travel. Thus, the platen can pivot through an arc of about 90° from a first position, wherein it is substantially congruent with its supporting carriage, to a second position wherein the platen is oriented so its longer dimension extends transverse the supporting carriage.

The bag receiving unit path of travel 14 passes in sequence through a product load zone 20, an evacuating zone 22, a bag sealing zone 24, and an unloading zone 26. From the unloading zone the units return to the product load zone 20.

As the bag receiving units 10 enter the evacuating zone 22 they merge and engage with evacuation chambers 28. The evacuation chambers generally are conventional and will not be described in detail. It is sufficient for purposes of the present invention to say that the chambers are arranged on a carousel 29 so individual chambers merge with and engage against a corresponding bag receiving unit adjacent a point of beginning 21 where the units 10 enter the evacuating zone 22. The vacuum chambers remain merged and engaged with the bag receiving units as the units traverse the evacuation zone 22. At the end of the evacuation zone, the vacuum chambers 28 separate from the bag receiving units 10. The units 10 shunt away from the vacuum chambers 28 as the carousel 29 carries each vacuum chamber back to the point of beginning.

Various arrangements are available to provide for the merging and engagement of each vacuum chamber 28 with an associated bag receiving unit 10. For example, as shown in U.S. Pat. No. 3,958,391 the vacuum chambers are held in a horizontal plane while the bag receiving units are elevated until they engage against the bottom of the evacuating chambers. An alternative and preferred arrangement as shown in U.S. Pat. No. 4,550,548 is to have the bag receiving units 10 remain in the same horizontal plane and to lower the vacuum chambers until they meet and engage against the bag receiving units. For this purpose, each evacuation chamber is supported on a radial arm 30 of the carousel. These arms 30 are hinged and are raised or lowered hydraulically by any suitable means (not shown). A vacuum line (not shown) is provided for communicating each vacuum chamber to a vacuum pump (also not shown).

In the load zone 20, an operator takes a bagged food product 48 from a conveyor 49, lays it onto the platen 18 and pulls the bagged product until it contacts against an upstanding anvil 32. The operator arranges the open neck 56 of the bag to a flat width and drapes the bag neck across the anvil 32. As the receiving unit leaves the loading zone, it traverses a trip cam 34. As will be described hereinbelow, the trip cam causes a bag clamping mechanism (not shown) carried by the receiving unit to move to a first clamping position wherein it loosely holds the open bag neck 56 to the anvil 32.

As the bag receiving units continue along the path of travel 14 they individually merge with one of the vacuum chambers 28 and enter the evacuation zone 22. In the evacuating zone the vacuum chambers 28 are evacuated and air is exhausted from the bags.

Prior to leaving the evacuation zone, the bag receiving units 10 traverse a second trip cam 36. This causes the bag clamping mechanism to move to a second position wherein it clamps the bag neck tightly against the anvil and closes it so that after the vacuum chamber vents and releases from the platen, the bag resting on the platen is maintained in an evacuated state.

At the end of the evacuation zone 22, the vacuum chamber disengages and separates from the bag receiving unit. After separation from the vacuum chamber, the platen 18 traverses a third cam 37. The engagement with cam 37 causes the platen to rotate 90° with respect to its carriage 16 so that the platen is positioned transverse the carriage path of travel. In this position the anvil 32 and the clamped bag neck 56 draped across the anvil are oriented parallel to the direction of the carriage path of travel 14. The carriage continues along its path of travel and enters the sealing zone 24 which contains a heat sealer 35. As the bag receiving units 10 pass through the sealing zone, the heat sealer effects a heat seal closure of the bag neck draped across anvil 32.

As each bag receiving unit exits the sealing zone 24, the platens 18 traverse a fourth cam 38 causing each platen to rotate 90° back to the position where it is congruent with its carriage 16. The bag receiving units 10 then enter the unloading zone 26 and traverse a fifth cam 39. This last cam causes the bag clamping mechanism to open so the bags, now evacuated and heat sealed, can be removed from the platen 18 for further processing.

FIGS. 2 and 3 show a bag receiving unit in more detail. As shown in FIG. 2, the carriage 16 has an upstanding hub 40 which pivotally supports the platen 18. A detent mechanism 42 between the platen and carriage allows the platen to fix at either of the two positions noted above. That is, in one position the platen is in a congruent alignment with carriage 16 and in a second position the platen is rotated 90° so it lies transverse the carriage. Any suitable detent mechanism may be provided and for purposes of illustration, FIG. 2 shows the detent to include a ball 44 which seats in either of two grooves 46 (only one of which is shown) defining the congruent and transverse positions.

The platen 18 defines the surface 45 for supporting a loaded bag 48 to be heat sealed and the anvil 32 upstands from an end 50 of the platen. When the platen is congruent with carriage 16, the platen end 50 trails in the direction of movement along the carriage path travel 14.

Anvil 32 has a substantially flat upper surface 52 which carries a sealing member such as a gasket or O-ring 54. As shown in FIG. 2 the unsealed neck 56 of the bag 48 is draped across the anvil surface 52 and sealing member 54 such that a portion of the bag neck including the open bag mouth indicated at 58 extends across and overhangs the anvil. As further described hereinbelow, the seal member 54 provides a first clamping surface for effecting a mechanical air-tight closure of the bag mouth.

Platen 18 carries the components which are activated by the trip cams 34, 36 and 39 for clamping and releasing the bag neck 56. Generally, these components as shown in FIGS. 2–7 are arranged in three cooperating assemblies including a clamp assembly generally indicated at 60, a drive means generally indicated at 62 and an over center lock generally indicated at 64.

The clamp assembly 60 includes the components which are movable to a first position to loosely hold the bag neck to the anvil during evacuation of the bag. These components also are movable to a second position to tightly close the bag neck after evacuation and maintain it closed until heat sealing. The drive means 62 is suspended from beneath the platen 18 by brackets, a portion of which is shown at 63. The drive means is operatively connected to the clamp assembly and it interacts directly with the trip cams 34, 39 respectively to close and open the clamp assembly. The over center lock 64 acting through the drive means 62 acts to hold the clamp assembly at either an open or closed position and applies a spring force to compliment the operation of the drive means.

Clamp Assembly

As shown in FIGS. 2 and 3, the clamp assembly 60 in the open position is located away from and below anvil 32. This insures that the clamp assembly does not interfer with loading the bagged product onto the platten and draping the bag neck 56 over the anvil 32. The clamp assembly 60 includes an elongated clamp bar 66 which is coextensive with anvil 32. The clamp bar is supported at its ends by clamp arms 68 only one of which is shown in the figures. The clamp arms 68 straddle the anvil and are pivotally connected to opposite sides of the platen. Only one clamp arm 68 is shown and the other is a duplicate pivotally connected to the opposite side of the platen. The arms are pivotable as further described hereinbelow to carry the clamp bar towards and away from the anvil.

The clamp bar 66 has an elongated clamp member 74 which is engageable against seal member 54 as described herein below. Thus, the clamp member 74 provides a second clamping surface which cooperates with the seal member 54 for effecting a mechanical air-tight closure of the bag mouth. In addition, a portion of the clamp bar defines a channel 72 (FIG. 3) which is open in the direction towards the platen. Disposed within the channel 72 is a pressing member 76 or "comb" having teeth 80 separated by recesses 82. A spring 78 acts to bias the comb through the open channel and against the anvil surface 52. The function of the comb 76 is to hold the bag neck loosely to the anvil surface and yet still allow air to escape from the bag. In this respect, when the clamp bar is in a first clamping position the teeth 80 provide lands which press portions of the bag neck against the anvil surface 52 while the recesses 82 between the teeth provide openings which allow air to excape from the bag.

The clamp bar 66 is moved towards and away from the anvil by the pivoting movement of clamp arms 68. As seen in FIG. 2, each clamp arm has an elongated slot 84. A fixed bearing 86 captured within the slot allows the clamp arm to pivot about the bearing and reciprocate with respect to the bearing. This compound motion is necessary for the clamp bar 66 to clear the bag open end 58 as it moves between the open and closed positions. Each clamp arm 68 also has a Projecting shoulder 88 adapted to catch against a stop 90 which is slidably carried by the anvil 32. Catching the shoulder 88 against the stop prevents the clamp bar 66 from closing tightly against the anvil during the evacuation of air from the bag 48.

Drive Means

The drive means 62 is operatively connected to the clamp assembly by a link 92. The link is pivotally connected at one end 94 to the clamp arm 68 and, at its other end, the link is fixed to a rotatable drive shaft 96. Also fixed to the drive shaft is a pinion gear 98 which in turn meshes with a spur gear 100. The spur gear is fixed to a shaft 102 and the spur gear shaft 102 in turn is fixed at one end to a lever arm 104. As best seen in FIG. 3, the lever arm 104 is provided with a cam follower 106 that is tripped by the cams 34 and 39 (FIG. 1). In this respect, as the cam follower 106 traverses the first trip cam 34, the follower is elevated. This moves the lever arm 104 clockwise as viewed in the figures and causes the shaft 102 and spur gear 100 to rotate clockwise. Pinion gear 98 is driven by the spur gear and rotates drive shaft 96 counter clockwise. The link 92, being fixed to the drive shaft likewise is driven counter clockwise and this pivots and translates the clamp arm from the position shown in FIG. 2 to the first clamping position shown in FIG. 4. Conversely, as the cam follower traverses trip cam 39, the follower is depressed. This triggers movement of the drive means in the opposite direction to return the clamp arm to the open position shown in FIG. 2.

Over Center Lock

As discussed above, it is the operation of cam follower 106 which triggers the operation of the drive means. However, it is the overcenter lock assembly 64 which provides the force to facilitate the operation of the drive means and to stabilize the clamp assembly at either the open or closed positions.

The overcenter lock assembly is connected to the spur gear shaft 102 so the force exerted by the over center lock assembly is transmitted directly to the drive means 62. In particular, FIG. 3 shows the overcenter lock includes a crank 108 connected eccentrically to spur gear shaft 102 by crank arm 110. A pair of tension springs 112 extend between the crank and the platen.

As shown in FIG. 2, the crank 108 is positioned below the axis of spur gear shaft 102. In this position the tension force of spring 112 is applied below center and leverage is exerted for opening, and holding open, the clamp assembly.

As noted above, elevating the cam follower 106 drives the spur gear shaft 102 clockwise and this carries the crank 108 above the axis of the spur gear shaft. In this position, the tension force of spring 112 is applied above center and leverage is exerted to close, and hold closed, the clamp assembly. It should be appreciated that the force exerted by springs 112 is adjustable to control the closing force exerted by the clamp means. Such an adjustment can be accomplished by changing the spring constant of springs 112.

Operation

The operation will be described beginning with reference to FIGS. 2 and 3. These figures show the position of components carried by the platen 18 as each bag receiving unit 10 enters the loading zone 20.

In the loading zone, an open heat sealable bag containing an article to be vacuum packaged is Placed onto platen 18 (FIG. 2). Preferably the product 51 within the bag is butted against the anvil 32 and the bag is pulled across the anvil so the length of bag material 53 between the product and the seal member 54 can be minimized thereby allowing the use of as short a bag as possible. Also, the bagged article 48 is arranged so the neck 56 of the bag which drapes across the anvil surface 52 is stretched to its flat width so as to eliminate, as much as possible, any wrinkles in the portion of the bag disposed across the anvil.

The carriage 16 moves along its path of travel 14 and eventually traverses trip cam 34. The trip cam engages cam follower 106 and deflects it upwardly which rotates spur gear shaft 102 clockwise as viewed in FIG. 2. The rotation of spur gear shaft 102 drives the meshed spur and pinion gears 100, 98 as described above and rotates link 92 counter clockwise from the open position shown in FIG. 2 to the first clamping position shown in FIG. 4.

As the link 92 rotates counter clockwise from its FIG. 2 position to its FIG. 4 position it drives clamp arm 68 about the fixed bearing 86. In this respect, the engagement of the fixed bearing in the elongated slot 84 causes the clamp arm 68 to translate with respect to the bearing as the clamp arm pivots about the bearing. The result is that the clamp bar 66 first is thrust above the level of anvil surface 52 and then is drawn downward toward the anvil surface. The clamp bar is drawn downwardly until the shoulder element 88 on the clamp arm catches against the stop 90 (FIG. 4).

The shoulder 88 catches against the stop 90 when the member 74 on the clamp bar 66 is still spaced above the anvil surface 52. However, since the comb 76 carried by the clamp bar is spring loaded, it is biased outwardly from channel 72 to the extent that its teeth 80 can press portions of the bag neck 56 against the anvil surface 52.

The clockwise rotation of shaft 102 by the lever arm 104 (and cam follower 106) also pivots the crank arm 110 clockwise. This carries the crank 108 from a position below the level of the spur gear shaft 102 as shown in FIG. 2 to the position shown in FIG. 4 wherein the crank is above the level of the spur gear shaft. In this position, the force exerted by springs 112 is transmitted by crank arm 110 and gears 98, 100 and link 92 to the clamp arm 68. The clamp arms 68 are urged downwardly by the spring force which firmly fixes shoulder 88 on the clamp arm against the stop 90.

With the components in this position the bag receiving units 10 proceed along the path of travel 14 (FIG. 1) to the point indicated at 21 where they merge with a vacuum chamber 28.

As noted hereinabove, the vacuum chambers carried by a carousel 29 are supported at the end of radial arms 30. After merging with a bag receiving unit, each radial arm lowers a vacuum chamber until the chamber seats against a carriage 16 and encloses the platen. The vacuum chamber and carriage then move into the evacuating zone 22 where the vacuum chamber 28 is communicated with a vacuum source to evacuate air from within the chamber and the bag. In the evacuation zone, FIG. 4 shows that the lands provided by the teeth 80 of comb 76 hold portions of the bag neck to the anvil surface 52. However, the unclamped spaces provided by the recesses 82 (FIG. 3) between the lands allows air to escape from the bag.

Prior to leaving the evacuation zone, the vacuum chambers 28 are carried past the second trip cam 36. This triggers the operation of a plunger 114 which, as shown in FIGS. 5, is carried by the vacuum chamber and extends slidably through the vacuum chamber wall 116 in alignment with stop 90. Seals 118 maintain an air tight seal between the plunger and the chamber wall.

When the plunger is triggered by cam 36, it is pressed inward against the stop 90 and kicks the slide from under the clamp arm shoulder 88.

As shown in FIG. 6, this releases the clamp arm 68 so it immediately and forceably is drawn downwardly. In this respect, the tension of springs 112 pulls the crank 108 farther over center and causes an additional clockwise rotation of crank arm 110.

This additional rotation of crank arm 110 is transmitted through shaft 102 and the meshed gears 100, 98 of the drive means 62 to link 92. The result is that the clamp arm 68 is drawn downwardly until the clamp member 74 on the clamp bar 66 is in its second sealing position seated tightly against the seal member 54 on the anvil surface 52 and exerts a predetermined clamping force against the seal member. As the clamp bar draws down towards the anvil surface 52, the spring biased comb 76 recedes into the channel 72 (FIG. 3) and does not interfer with the seating of the clamp member 74 against the seal member 54.

In this fashion there is provided a mechanical airtight seal of the bag neck 56 draped across the anvil surface 52. The seal is effected with a predetermined clamping force which is sufficient to prevent air entry into the bag.

The vacuum chamber is vented to atmosphere in a conventional manner and the radial arms 30 are raised to separate the vacuum chamber from the carriage. The venting of the chamber to atmosphere and the resulting rapid increase in the air pressure exerted against the exterior surface of the bag collapses the bag against the food article within the bag. Any air remaining in the bag is compressed by the collapsing bag. The pressure of the compressed air exerts a force which exceeds the predetermined clamping force of the clamp member 74 against the seal member 54. The result is that any air remaining in the bag is forced between the seal 54 and clamp member 74 and is expelled from the bag.

FIG. 1 shows that each vacuum chamber 28, now separated from its associated bag receiving unit 10, is carried around by the carousel 29 to the point of beginning 21 until the bag receiving units shunt away from the vacuum chamber along the path of travel 14. After the bag receiving units leave the evacuation zone 22, a cam 37 disposed in the path of travel of platen 18 engages the platen and rotates it 90° with respect to carriage 16 so the longitudinal axis of the platen is oriented transverse the carriage path of travel 14. At the 90° position, detent 42 engages to hold the platen 18 from pivoting farther with respect to the carriage 16. The platen, in this position, is carried along by the carriage into the sealing zone 24 where the portion of the bag neck 56 extending from the anvil 32 is heat sealed. During the course of its passage from the evacuating zone to the sealing zone, the bagged product 48 is exposed to atmospheric pressure. However the clamp bar 66 remains in position to effect an air-tight mechanical seal of the bag neck 56.

By rotating the platen 90°, the portion of the bag neck draped across the anvil 32 and extending out from under the clamp bar 66 is brought into alignment with a heat sealer 35. Preferably the heat sealer in the sealing zone is a band sealer. Band sealers per se are conventional and need not be described in detail except to say that heat sealing is performed by a pair of heated endless belts which press against layers of film moving between the belts. Accordingly, as the bag receiving units move towards the band sealer, the neck portion of the bag neck 56 draped across the anvil and extending from under the clamp bar 66 is guided between the endless belts of the band sealer. The belts heat and press against the bag film to provide the bag neck with a permanent air tight heat seal without stopping the movement of the bag.

As the bag receiving units leave the sealing zone 24, cam 38 rotates the platen 90° back to its carriage congruent position. The bag receiving units continue along the path of travel and pass over cam 39. Cam 39 engages the cam follower of the drive means 62 (FIG. 2) and deflects the cam follower counter clockwise as viewed in the figures. This causes the spur gear shaft 102 to rotate counter clockwise and reverses the operation of the drive means 62. Reversing the operation of the drive means causes the clamp arms 68 to move vertically and then to rotate to the open position as shown in FIG. 2. As the spur gear shaft 102 rotates counter clockwise, it also carries crank 108 to a position below the spur gear shaft 102 (FIG. 2). In this position, the tension exerted by springs 112 now holds the clamp bar 66 in the open position.

In this fashion clamp bar 66 is removed from the anvil surface 52 to release the heat-sealed bag neck. The sealed bag is then removed from the platen either manually or by a mechanical pusher (not shown) and the bag receiving units return to the load zone where an operator places another open bag on the platen.

It should be appreciated that the vacuum packaging method and apparatus of the present invention provides a simplified arrangement for the continuous packaging of food items in heat sealable plastic bags. Multiple heat sealers, that is a heat sealer associated with each bag carrying unit 10, are eliminated. The multiple heat sealers are replaced with a mechanically operated clamping device which closes the bag after evacuation and maintains it closed while the bags are sealed outside of the vacuum chambers. This arrangement allows a longer evacuation time because the time otherwise taken to effect a heat seal within the vacuum chamber can now be added to the evacuation time. Also, by effecting the heat seal outside the vacuum chamber the heat sealing cycle and the time for cooling the heat seal can be increased. That is, the time taken for these actions is not dictated by the time allowed for retention of the bags in the vacuum chambers. The method and apparatus of the present invention further simplifies machine design by eliminating the supply of utilities such as electrical power, cooling water and compressed air to each of the bag carrying units.

While one embodiment of the present invention has been described, other arrangements within the scope of the appended claim are possible. For example, the sealing zone may contain two band sealers. In this way one will provide back-up during maintenance or repair of the first. Also, the band sealer can be replaced by any other suitable heat sealing device such as an impulse sealer, an ultrasonic welder or a sealing device using radio frequency (R. F. sealer). If a sealer such as an impulse sealer is used, the movement of the platen must be halted during heat sealing or the impulse sealer must be arranged to track the movement of the platen during heat sealing.

In still another arrangement a heat sealer in the sealing zone can be disposed transverse the carriage path of travel 14 to avoid the need to rotate the platen with respect to the carrier. If the heat sealer is disposed transverse the carriage path of travel, it can be arranged to drop into position for engaging and sealing the portion of the bag neck extending from between the anvil and the clamp bar. In this case the movement of the carriages can be intermittent and in timed relation to the operation of the heat sealer. As an alternative, the heat sealer can be arranged to drop into position and then to track the movement of the carriage through the sealing zone.

Having described the invention in detail, what is claimed as new is:

1. A method of vacuum packaging articles in sealable bags comprising the steps of:

a) placing an open article-containing sealable bag at a loading zone and drawing the open neck of the bag to a flat width over a first clamp surface;

b) moving the article-containing bag and first clamp surface into an evacuation zone and at least partly evacuating air from the bag through the open neck while holding the neck at substantially its flat width over the first clamp surface;

c) moving a second clamp surface against the first clamp surface in the evacuating zone and clamping the bag neck therebetween for effecting a temporary gas-tight seal of the evacuated, article-containing bag;

d) moving the evacuated, article-containing bag from the evacuation zone through a region of atmospheric pressure to a sealing zone and maintaining said temporary gas-tight seal during said movement through the atmospheric pressure region;

e) sealing the clamped bag neck across its flat width in the sealing zone to effect a permanent gas-tight seal closure of the bag neck; and f) moving the permanently sealed, evacuated, article-containing bag from the sealing zone to an unloading zone, unclamping the bag neck and removing the permanently sealed article-containing bag from between the said clamping surfaces.

2. A method of vacuum packaging articles in sealable bags comprising the steps of:

a) providing a platen movable in a closed path through successive loading, evacuating and sealing zones;

b) placing an open sealable bag containing the article to be package on the platen at the loading zone, drawing the open neck of the bag to a flat width and draping it over a first clamp surface;

c) moving the platen with the article-containing bag to an evacuation zone and at least partially evacuating air from the bag through the open neck;

d) while maintaining the partial vacuum, clamping the bag neck at its flat width to the clamp surface and thereby effecting a temporary air-tight seal of the bag;

e) moving the platen from the evacuation zone to the sealing zone and exposing the bag in transit to atmosphere pressure while maintaining the temporary air tight seal thereof;

f) sealing the clamped bag neck across its flat width in the sealing zone to effect a permanent air-tight seal closure of the bag mouth; and g) moving the platen from the sealing zone to an unloading zone, unclamping the bag neck and removing the sealed bag.

3. A method as in claim 2 wherein draping the bag neck over said clamp surface orients the bag neck transverse the platen path of travel.

4. A method as in claim 3 including rotating the platen with respect to its path of travel for orienting the bag neck in the direction of the path of travel prior to entering the sealing zone.

5. A method as in claim 4 including continuously moving the platen through the sealing zone and sealing the bag neck during the transit thereof through the sealing zone.

6. A method as in claim 5 including sealing the bag by progressively and continuously forming a heat seal band across the bag as the bag traverses the sealing zone.

7. A method as in claim 5 including rotating the platen after sealing the bag neck back to a position wherein the bag neck is oriented transverse the platen path of travel.

8. A method as in claim 4 including stopping the platen in the sealing zone and then effecting a permanent air-tight seal closure by heat sealing the bag.

9. A method as in claim 2 wherein exposing the evacuated bag to atmosphere pressure at said moving step (e) collapses the bag against the food product therein and causes the expressing of residual air from said evacuated bag through said clamped bag neck.

10. A method as in claim 2 including adjusting the force applied for clamping the bag neck at step (d) to a predetermined value sufficient to permit the expressing of residual air from said evacuated bag through said clamped bag neck upon the exposure of the evacuated bag to atmospheric pressure at said moving step (e).

11. A method as in claim 1 or 2 wherein clamping said bag neck is accomplished by moving a clamp bar to a position pressing against the first clamp surface and maintaining the clamp bar pressing against the first clamp surface with an overcenter applied spring force.

12. A method as in claim 11 wherein unclamping is accomplished by pivoting the clamp bar against the spring force to an open position and maintaining the clamp bar in an open position with an over center applied spring force.

13. A method as in claims 1 or 2 comprising holding the bag neck to the first clamp surface at a plurality of spaced locations and evacuating air from the bag through openings intermediate the spaced locations and thereafter clamping the bag neck to the first clamp surface for effecting said temporary air-tight seal.

14. A method as in claim 2 including:

a) providing the clamp surface on a support upstanding from the platen; and b) placing the open article-containing bag on the platen with the food article in the bag located against the support thereby minimizing the length of the bag neck extending between the food article and the temporary air-tight seal.

15. Vacuum packaging apparatus comprising:

a) a carrier adapted to receive an open-necked bag containing an article to be packaged, said carrier being transportable through successive loading, evacuating, sealing and unloading zones;

b) said apparatus having a region of atmospheric pressure between said evacuating and sealing zones;

c) clamp means on said carrier movable between an open position and a closed position and being constructed and arranged to clamp said open bag neck to substantially its flat width;

d) drive means on said carrier for moving said clamp means between said open and closed positions;

e) first activating means in said evacuating zone for activating said drive means to move said clamp means to said closed position after at least partial evacuation of said article-containing bag to effect a temporary air-tight seal of said article containing bag and thereafter maintaining said clamp means in said closed position during movement of said carrier through said region of atmospheric pressure;

f) sealing means in said sealing zone for effecting a permanent air-tight seal closure of said clamped bag neck across its flat width; and g) second activating means after said sealing zone for activating said drive means to move said clamp means to said open position thereby releasing said bag neck and allowing the removal of said permanently sealed article-containing bag from said carrier in said unloading zone.

16. Vacuum packaging apparatus comprising:

a) a plurality of bag receiving units, each having a support surface for receiving a bag to be sealed and a clamp surface for receiving an open neck portion of a said bag;

b) transport means for moving said bag receiving units through a closed path of travel through loading, evacuation, sealing and unloading zones;

c) a plurality of vacuum chambers movable through a second closed path of travel including said evacuation zone, each chamber being adapted to mate with a bag receiving unit on entry into said evacuation zone and to separate from said bag receiving unit on exit from said zone, said chamber and bag receiving unit when mated providing an air tight seal therebetween;

d) evacuating means communicating with each vacuum chamber for evacuating at least part of the air from a said bag on said support surface during transit through said evacuation zone;

e) a clamp member on each bag receiving unit movable between an open position spaced from said clamp surface and a closed position pressed tightly against said clamp surface, said clamp member being arrange to clamp a said open neck portion to substantially its flat width;

f) drive means on each bag receiving unit operably connected to said clamp member and being operable adjacent the exit of said evacuation zone for moving said clamp member to said closed position prior to said bag receiving unit leaving said evacuation zone thereby clamping shut said open bag neck received on said clamp surface and preserving the evacuated state of a said bag upon separation of said vacuum chamber and bag receiving unit;

g) sealing means in said sealing zone engagable against a portion of a said clamped bag neck to effect a permanent air-tight seal of the clamped bag neck across its flat width; and h) said drive means being operable in reverse adjacent the entry of said unloading zone for moving said clamp member to its open position thereby releasing a said bag neck and allowing the removal of a sealed bag from said support surface.

17. Vacuum packaging apparatus as in claim 16 wherein each of said bag receiving units comprises:

a) a carriage fixed to said transport means for movement through said closed path of travel;

b) a platen carried by said carriage, said platen including said support surface and said clamp surface being disposed transverse said platen; and c) means mounting said platen to permit rotation to said platen with respect to said carriage in an arc of about 90° between a first position wherein said clamp surface is oriented transverse said carrier path of travel and a second position wherein said clamp surface is oriented generally parallel to said carrier path of travel.

18. Vacuum packaging apparatus as in claim 17 including means between said evacuating zone and sealing zone for rotating said platen from said first position to said second position.

19. Vacuum packaging apparatus as in claim 18 including means between said sealing zone and said loading zone for rotating said platen from said second position to said first position.

20. Vacuum packaging apparatus as in claim 16 wherein said sealing means comprises at least one band heat sealer and said transport means operates to move said bag receiving units continuously through said sealing zone.

21. Vacuum packaging apparatus as in claim 16 wherein said sealing means comprises at least one impulse heat sealer and said transport means operates to move said bag receiving units intermittently through said sealing zone.

22. Vacuum packaging apparatus as in claim 16 comprising a plurality of actuators positioned at fixed locations along said closed path of travel for triggering the operation of said drive means including:

a) a first actuator at a fixed position at the entrance to said evacuation zone engageable with said drive means and operable to move said clamp member from its open position to a partly closed position wherein said clamp member holds said bag neck to said clamp surface at spaced locations, the areas of said bag neck between said spaced locations being unclamped to permit the exhaust of air from said bag;

b) a second actuator at a fixed position in said evacuation zone and adjacent the exit thereof operable to cause said drive means to move said clamp member to said closed position; and c) a third actuator at a fixed position between said sealing zone and unloading zone and engageable with said drive means for moving said clamp member from said close position to said open position.

23. Vacuum packaging apparatus as in claim 16 wherein said drive means includes a gear train having a cam follower at an input end and a link at an output end operably connected to said clamp member, the movement of said cam follower in one direction rotating said gear train to operate said link and clamp member; and a first actuator at the entrance of said evacuation zone and positioned in the path of travel of said cam follower for rotating said cam follower in said one direction.

24. Vacuum packaging apparatus as in claim 23 having an overcenter lock including bias means operating through said gear train to urge said clamp member to either its open or closed positions.

25. Vacuum packaging apparatus as in claim 24 including;

a) a slidable stop in the path of said clamp member for preventing said clamp member from moving to said closed position responsive to the urging of said bias means, said stop and clamp member being engaged at a partly closed position wherein said clamp member holds said bag neck to said clamp surface at spaced locations;

b) a stop release means carried by said vacuum chamber operable to kick said slidable stop out of engagement with said clamp member thereby allowing movement of said clamp member to its closed position response to the urging of said bias means; and c) a second actuator located in the evacuation zone and positioned in the path of travel of said stop release means for operating a said stop release means as it traverses said second actuator

26. Vacuum packaging apparatus as in claim 25 including a third actuator positioned between said sealing zone and unloading zone in the path of said cam follower for rotating said cam follower in a reverse direction thereby rotating said gear train in reverse to move said clamp member to said open position.

27. Vacuum packaging apparatus as in claim 16 wherein each of said bag receiving units has a transverse anvil upstanding from said support surface adjacent one end of said bag receiving unit and an upper surface of said anvil comprises said clamp surface, a said bag received on said support surface having its neck portion draped across said anvil upper surface.

28. A method of vacuum packaging articles in sealable bags comprising the steps of:

a) providing a platen movable in a closed path through successive loading, evacuating and sealing zones;

b) placing an open sealable bag containing the article to be packaged on the platen at the loading zone, drawing the open neck of the bag to a flat width and draping it over a clamp surface such that the bag neck is oriented transverse the platen path of travel;

c) moving the platen with the article-containing bag to an evacuation zone and at least partially evacuating air from the bag through the open neck;

d) while maintaining at least a partial vacuum in said evacuation zone, clamping the bag neck at its flat width to the clamp surface and thereby effecting a temporary air-tight seal of the bag;

e) moving the platen from the evacuation zone to the sealing zone and exposing the bag in transit to atmosphere pressure while maintaining the temporary air-tight seal thereof;

f) rotating the platen with respect to its path of travel for orienting the bag neck in the direction of the platen path of travel prior to entering the sealing zone;

g) sealing the clamped bag neck across its flat width in the sealing zone to effect a permanent air-tight seal closure of the bag mouth; and h) moving the platen from the sealing zone to an unloading zone, unclamping the bag neck and removing the sealed bag.

29. Vacuum packaging apparatus comprising:

a) a plurality of bag receiving units;

b) transport means for moving said bag receiving units in a closed path of travel through successive loading, evacuation, sealing and unloading zones;

c) each bag receiving unit including (i) a carriage fixed to said transport means, (ii) a platen on said carriage, said platen having a support surface for receiving a bag to be sealed and a clamp surface for receiving an open neck portion of a said bag and said clamp surface being disposed transverse said platen;

d) means mounting said platen to said carriage to permit the rotation of said platen with respect to said carriage in an arc of about90° between a first position wherein said clamp surface is oriented transverse the path of travel of said carriage and a second position wherein said clamp surface is oriented generally parallel to said carriage path of travel;

e) a plurality of vacuum chambers movable through a second closed path of travel including said evacuation zone, each chamber being adapted to mate with a bag receiving unit on entry into said evacuation zone and to separate from said bag receiving unit on exit from said zone, said chamber and bag receiving unit when mated providing an air tight seal therebetween;

f) evacuating means communicating with each vacuum chamber for evacuating at least part of the air from a said bag on said support surface during transit through said evacuation zone;

g) a clamp member on each bag receiving unit movable between an open position spaced from said clamp surface and a closed position pressed tightly against said clamp surface said clamp member being arrange to clamp a said open neck portion substantially its flat width;

h) drive means on each bag receiving unit operable adjacent the exit of said evacuation zone for moving said clamp member to said closed position prior to said bag receiving unit leaving said evacuation zone thereby clamping shut said open bag neck received on said clamp surface and preserving the evacuated state of a said bag upon separation of said vacuum chamber and bag receiving unit;

i) sealing means in said sealing zone engagable against a portion of a said clamped bag neck to effect a permanent air-tight seal of the clamped bag neck across its flat width thereof; and j) said drive means operable in reverse adjacent the entry of said unloading zone for moving said clamp member to its open position thereby releasing a said bag neck and allowing the removal of a sealed bag from said support surface.

30. Vacuum packaging apparatus comprising:

a) a plurality of bag receiving units, each having a support surface for receiving a bag to be sealed and a clamp surface for receiving an open neck portion of a said bag;

b) transport means for moving said bag receiving units, through a closed path of travel through successive loading, evacuation, sealing and unloading zones;

c) a plurality of vacuum chambers movable through a second closed path of travel including said evacuation zone, each chamber being adapted to mate with a bag and to separate from said bag receiving unit on exit from said zone, said chamber and bag receiving unit when mated providing an air tight seal therebetween;

d) evacuating means communicating with each vacuum chamber for evacuating at least part of the air from a said bag on said support surface during transit through said evacuation zone;

e) a clamp member on each bag receiving unit movable between an open position spaced from said clamp surface and a closed position pressed tightly against said clamp surface said clamp member being arrange to clamp a said open neck portion to substantially its flat width;

f) drive means on each bag receiving unit operably connected to said clamp member;

g) a first actuator at a fixed position at the entrance to said evacuation zone engagable with said drive means for operating said drive means to move said clamp member from its open position to a partly closed position wherein said clamp member holds said bag neck to said clamp surface at spaced locations, the areas of said bag neck between said spaced locations being unclamped to permit the exhaust of air from said bag;

h) a second actuator at a fixed position in said evacuation zone and adjacent the exit thereof engagable with said drive means for operating said drive means to move said clamp member to said closed position prior to said bag receiving unit leaving said evacuation zone thereby clamping shut said open bag neck received on said clamp surface and preserving the evacuated state of a said bag upon separation of said vacuum chamber and bag receiving unit;

i) sealing means in said sealing zone engagable against a portion of a said clamped bag neck to effect a permanent air-tight seal of the clamped bag neck across its flat width thereof; and j) a third actuator at a fixed position between said sealing zone and unloading zone and engagable with said drive means for operating said drive means to move said clamp member from said closed position to said open position adjacent the entry of said unloading zone thereby releasing a said bag neck and allowing the removal of a sealed bag from said support surface.

31. Vacuum packaging apparatus comprising:

a) a plurality of bag receiving units, each having a support surface for receiving a bag to be sealed and a clamp surface for receiving an open neck portion of a said bag;

b) transport means for moving said bag receiving units through a closed path of travel through successive loading, evacuation, sealing and unloading zones;

c) a plurality of vacuum chambers movable through a second closed path of travel including said evacuation zone, each chamber being adapted to mate with a bag receiving unit on entry into said evacuation zone and to separate from said bag receiving unit on exit from said zone, said chamber and bag receiving unit when mated providing an air tight seal therebetween;

d) evacuating means communicating with each vacuum chamber for evacuating at least part of the air from a said bag on said support surface during transit through said evacuation zone;

e) a clamp member on each bag receiving unit movable between an open position spaced from said clamp surface and a closed position pressed tightly against said clamp surface said clamp member being arrange to clamp a said open neck portion to substantially its flat width;

f) drive means on each bag receiving unit for moving said clamp member, said drive means including a gear train, a cam follower at an input end of said gear train and a link at an output end operably connected to said clamp member, the movement of said cam follower in one direction rotating said gear train to operate said link for moving said clamp member to said closed position prior to said bag receiving unit leaving said evacuation zone thereby clamping shut said open bag neck received on said clamp surface and preserving the evacuated state of a said bag upon separation of said vacuum chamber and bag receiving unit;

g) a first actuator at the entrance of said evacuation zone and positioned in the path of travel of said cam follower for rotating said cam follower in said one direction;

h) sealing means in said sealing zone engagable against a portion of a said clamped bag neck to effect a permanent air-tight seal of the clamped bag neck across its flat width thereof; and i) said cam follower being operable in reverse adjacent the entry of said unloading zone to operate said link for moving said clamp member to its open position thereby releasing a said bag neck and allowing the removal of a sealed bag from said support surface.

* * * * *